US008015759B1

(12) United States Patent
Bruce

(10) Patent No.: US 8,015,759 B1
(45) Date of Patent: Sep. 13, 2011

(54) STRUCTURAL MOUNTING FOR EQUIPMENT ON A ROOFTOP

(75) Inventor: Ryan W. Bruce, Scotts Valley, CA (US)

(73) Assignee: Roofscreen Mfg., Santa Cruz, CA (US)

( * ) Notice: Subject to any disclaimer, the term of this patent is extended or adjusted under 35 U.S.C. 154(b) by 494 days.

(21) Appl. No.: 11/204,911

(22) Filed: Aug. 16, 2005

(51) Int. Cl.
*E04H 12/20* (2006.01)

(52) U.S. Cl. ..... 52/146; 52/25; 52/147; 52/149; 52/649.5; 52/58; 403/93; 248/514

(58) Field of Classification Search ..... 52/146, 52/147, 149, 649.5, 25, 58; 403/93, 96, 97, 403/150, 151; 248/514, 515, 520, 292.12, 248/346.5; 16/86.1, 86.2; 256/65.14; 135/120.2, 135/909, 155; 43/21.2, 22
See application file for complete search history.

(56) References Cited

U.S. PATENT DOCUMENTS

| | | | | | |
|---|---|---|---|---|---|
| 978,684 | A * | 12/1910 | Williams | 254/24 |
| 2,834,025 | A * | 5/1958 | Leavy | 623/33 |
| 3,362,037 | A * | 1/1968 | Griffin | 15/229.6 |
| 4,570,396 | A * | 2/1986 | Struben | 52/90.2 |
| 5,265,969 | A * | 11/1993 | Chuang | 403/94 |
| 5,429,481 | A * | 7/1995 | Liu | 416/246 |
| 5,551,745 | A * | 9/1996 | Huang | 296/111 |
| 5,603,187 | A * | 2/1997 | Merrin et al. | 52/58 |
| 5,862,637 | A | 1/1999 | Bruce | 52/147 |
| 5,921,014 | A * | 7/1999 | Lee | 43/21.2 |
| 6,205,719 | B1 | 3/2001 | Bruce | 52/147 |
| 6,782,668 | B2 | 8/2004 | Bruce | 52/147 |
| 6,789,848 | B2 * | 9/2004 | Rauschenberger et al. | 297/369 |
| 6,845,592 | B2 * | 1/2005 | Voegele | 52/466 |
| 7,007,906 | B2 * | 3/2006 | Slatter | 248/276.1 |
| 2002/0046506 | A1 | 4/2002 | Ullman | 52/1 |
| 2003/0070698 | A1 * | 4/2003 | Wells | 135/20.1 |
| 2003/0188500 | A1 * | 10/2003 | Voegele | 52/466 |
| 2006/0102822 | A1 * | 5/2006 | Liang | 248/514 |

* cited by examiner

*Primary Examiner* — Eileen Lillis
*Assistant Examiner* — Alp Akbasli
(74) *Attorney, Agent, or Firm* — Schneck & Schneck; Thomas Schneck

(57) ABSTRACT

A structural support for supporting equipment on a rooftop, which is connected to a frame and to equipment to be supported, comprises a mechanism connecting a base cap and a base connector of the structural support. One of the base cap and the base connector includes at least one plate and the other of the base cap and the base connector includes a pair of plates that receives the at least one plate allowing for pivoting adjustments of the base connector about the base cap when the at least one plate is received within an opening between the pair of plates to achieve desired positioning of the base connector. In one example, a pair of base cap plates is received by a pair of inwardly biased base connector plates. Once a desired position is achieved, a fastening assembly secures the position of the base connector. The structural mounting may also include, for example, a base support, a base flashing, and a rubber base gasket.

1 Claim, 9 Drawing Sheets

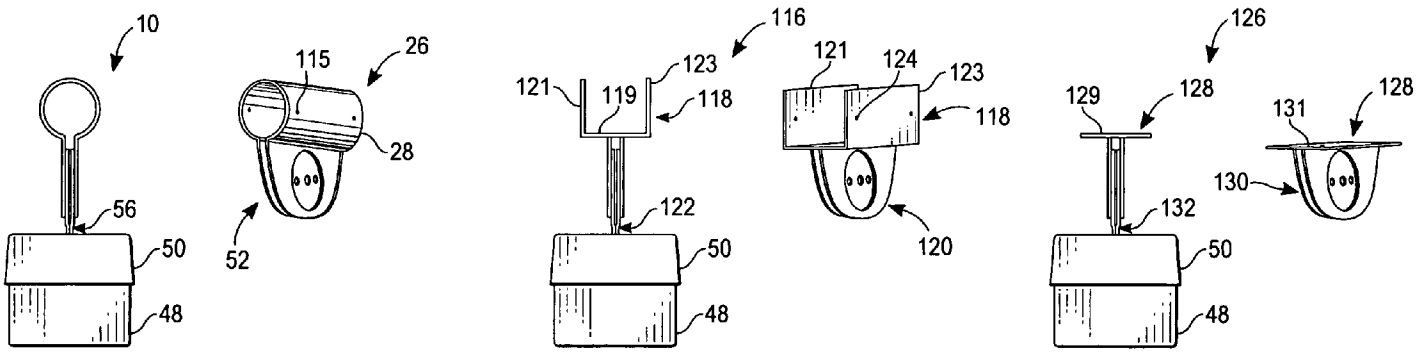
Fig._ 8a
Fig._ 8b
Fig._ 8c
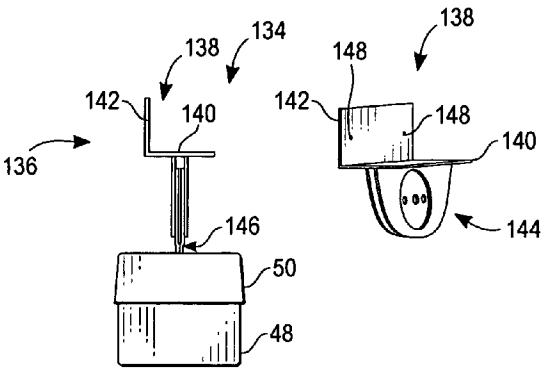
Fig._ 8d
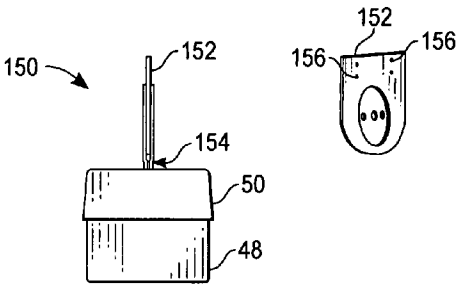
Fig._ 8e

STRUCTURAL MOUNTING FOR EQUIPMENT ON A ROOFTOP

FIELD OF THE INVENTION

The invention relates to a structural support for equipment on a rooftop.

BACKGROUND ART

Various types of rooftop equipment such as air conditioners, ventilation equipment, pipes, electrical boxes, and roof screens are subject to extreme forces on a rooftop such as winds and storms which may put the equipment at risk for being blown off the rooftop or otherwise damaged. Therefore, it is desirable to provide a structural support for supporting the equipment on the rooftop.

Various systems have been proposed for supporting a roof screen on a rooftop. In particular, U.S. Pat. No. 6,782,668 to Bruce, the inventor of the present invention, describes a roof screen system for supporting a roof screen comprising front, bottom, and diagonal frame elements secured to each other with end and field connectors. The bottom frame element is connected to base supports. A base cap of the base support has an opening that aligns with an opening of the base connector before connecting the base connector to the cap.

U.S. Pat. No. 6,205,719 to Bruce describes a roof screen system including a number of frames assembled from beams and held together with pivotable clamps allowing a slip-connection along the aluminum beam.

U.S. Pat. No. 5,862,637 to Bruce describes a roof screen system for securing a roof screen to a roof comprising a support unit having aluminum beams held together in a triangular shape. A weatherproofing assembly is disposed about the base elements to prevent water from collecting on the base.

Though some of the prior art support systems may provide for adjustments to be made during positioning of the frame elements, there exists a need for another support system that allows for adjustments to be made during positioning of the frame elements. Therefore, it is an object of the present invention to provide a structural support that allows for adjustments to be made when positioning frames and/or structural support elements.

Further, there exists a need for a structural support for supporting different types of equipment on a rooftop including, but not limited to, air conditioners, ventilation equipment, pipes, electrical boxes, and roof screens. Thus, it is another object of the present invention to provide a structural support that supports different types of equipment on a rooftop.

It is another object of the present invention to provide a new and improved structural support and/or one or more new and improved components of a structural support.

SUMMARY OF INVENTION

These and other objects have been achieved by a structural mounting for supporting equipment featuring a base cap and a base connector where the base connector is configured to be adjustable or to pivot about the base cap to achieve a desired position of the base connector for easy connection to a frame element connected to the equipment to be supported. One of the base cap and the base connector includes a pair of plates having an opening there between and the other of the base cap and the base connector include at least one plate that is received by the opening. In one example, the base connector includes a pair of plates having an opening there between that is large enough to receive two plates disposed on the base cap. When the base connector plates receive the base cap plates, the base connector is pivotable or otherwise adjustable about the base cap. The structural mounting is connected to a frame including frame elements that are connected to the equipment to be supported. The frame elements are, in one example, triangular in shape when connected.

The adjustable movement of the base connector allows for an easier connection of the base connector to one or more frame elements. In particular, in one example, a position of a frame support of the base connector is adjusted as the base connector pivots about the base cap to allow the frame support of the base connector to easily receive a frame element while the base connector still maintains a position that allows for it to be secured to the base cap. Also, a position of a fin which is, in one example, connected to the frame support is adjusted as the base connector pivots about the base cap to allow the fin of the base connector to easily connect to other types of connectors present on other frame elements so that the frame elements may be connected to one another to support the equipment on a rooftop. Connectors, such as end connectors and field connectors, are described in U.S. Pat. No. 6,782,668.

The frame includes at least one series of one bottom frame element, one diagonal frame element, and one front frame element. In one example, the frame elements are connected as follows. The bottom frame element is supported by the frame support of the base connector. In one example where the base connector has a fin, the fin of the base connector attaches to an end connector of a diagonal frame element connecting the bottom frame element to the diagonal frame element. The bottom frame element is attached to an end connector which is connected to a field connector to which a front frame element is attached. The front frame element is connected to a panel or other structure belonging to the equipment to be supported. The structural mounting and connected frame elements support connected equipment on a rooftop.

In one example of the present invention, each side of the plates of the base connector and base cap include a recessed area which receives a washer used in conjunction with a nut and bolt assembly to secure the base connector to the base cap at a desired position. Teeth may be disposed about each recessed area. The teeth disposed about one recessed area of one of a first pair of plates interlock with teeth disposed about one recessed area of one of a second pair of plates when the base connector and base cap are bolted or otherwise secured together.

In one example of the present invention, a structural mounting further includes, beneath the base cap, a base gasket, typically rubber, disposed about a base flashing. The base gasket prevents water from contacting the inside of the flashing and the base support.

In one example of the present invention, a base flashing comprises a riser having creases which may be broken off of the riser to adjust the riser height.

In another example of the present invention, the structural mounting further comprises a base surface of a base support. A portion of the base support is elevated from the rooftop surface to form a chamber between the rooftop surface and the base support surface. Fastener thru-holes are disposed in the raised surface. Fasteners are disposed in the holes and extend through the chamber to the roof. A sealant is poured or injected into the chamber around the fasteners to seal the fasteners.

BRIEF DESCRIPTION OF THE DRAWINGS

FIG. 8*a* is a side view of an example structural mounting of the present invention and a frame support comprising a tube which is included in the structural mounting.

FIG. 8*b* is a side view of an example structural mounting of the present invention and a frame support comprising a flat plate and two opposed sides which is included in the structural mounting.

FIG. 8*c* is a side view of an example of a structural mounting of the present invention and a flat plate mount which is included in the structural mounting.

FIG. 8*d* is a side view of an example of a structural mounting of the present invention and an "L" shaped mount which is included in the structural mounting.

FIG. 8*e* is a side view of an example of a structural mounting of the present invention and a vertical plate mount which is included in the structural mounting.

DETAILED DESCRIPTION

Figure 1:
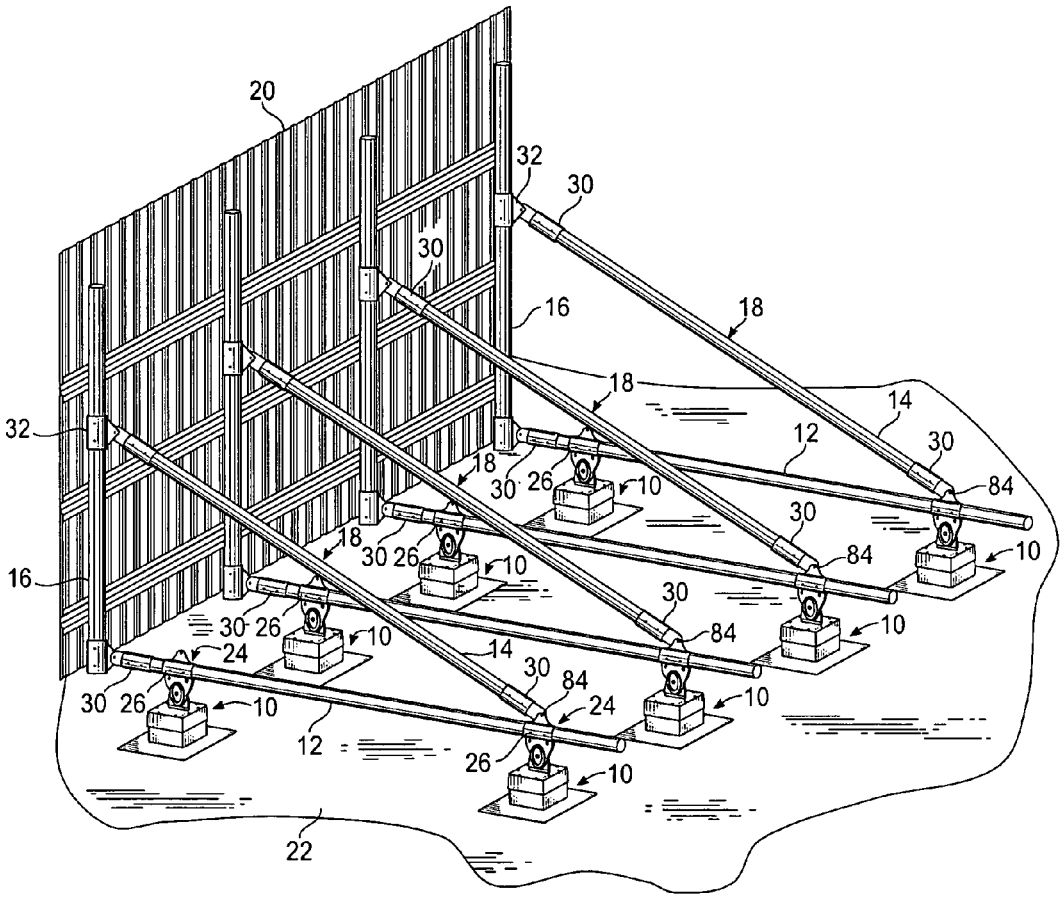
FIG. 1 is a perspective view of an example of the structural mounting of the present invention and an example frame and paneling connected to the structural mounting.

With reference to FIG. 1, there is seen an example of a structural mounting 10 of the present invention connected to frame elements 12, 14, and 16 of a frame 18. A plurality of structural mountings connected to a plurality of frames is depicted. Any number and type of frames using any number of structural mountings may be used. The frame 18 is connected to a panel 20 or other structure (not shown) connected to or a part of equipment to be supported on a rooftop 22. The structural mounting 10 and connected frame elements support equipment on a rooftop. The frame 18, which is typically triangular in shape when the example frame elements are connected, includes a bottom frame element 12, a diagonal frame element 14, and a front frame element 16. The frame, in one example, is comprised of round galvanized steel tubing elements or other durable material. The structural mounting 10 is secured to the bottom frame element 12 with a base connector 24 having a frame support 26 supporting the bottom frame element 12. In this example, the frame support 26 is a tube 28 (FIG. 2) sized to telescope over the frame elements before it is secured. Other frame supports will be described below.

Figure 7A:
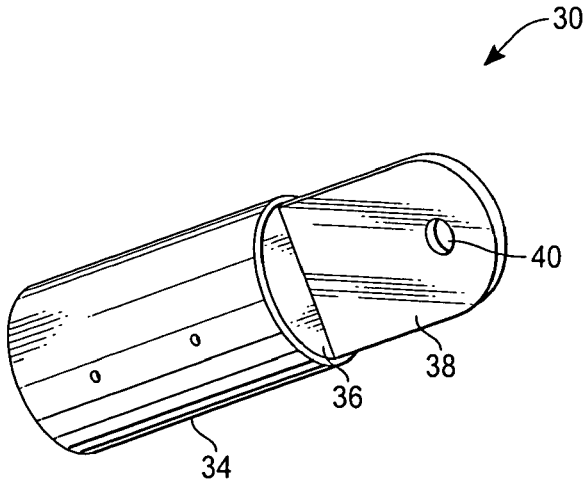
Fig. 7a (Prior Art)
FIG. 7*a* is a perspective view of a prior art end connector.
Figure 7B:
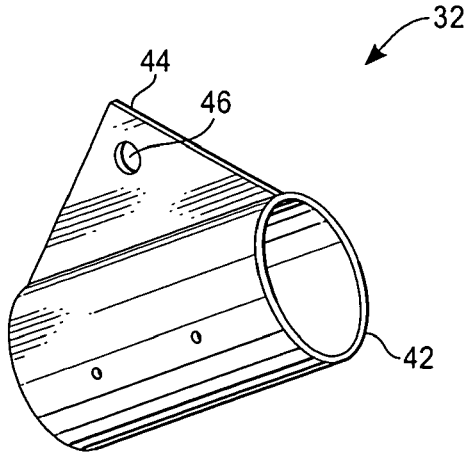
Fig. 7b (Prior Art)
FIG. 7*b* is a perspective view of a prior art field connector.

In one example, an end connector 30 (FIG. 7*a*) and a field connector 32 (FIG. 7*b*) secure the frame elements to one another. The end connector 30 may comprise, in one example, a tube 34 sized to telescope over a frame element and an end cap 36 welded to the end connector, in one example, to provide a surface for a fin arm 38, as described in U.S. Pat. No. 6,782,668. Fin arm 38 includes the aperture 40 for a pivot bolt. As seen in FIG. 1, the end connector 30 connects the end of the frame element 12 and/or 14 to the field connector 32 on frame 16 and/or frame support 26 (FIG. 2) of the base connector 24 on frame 12. When connecting frame elements, an aperture 40 of the field connector 30 (FIG. 7*a*) is aligned with an aperture 82 (FIG. 2) of the frame support 26 and/or with an aperture 46 (FIG. 7*b*) of the field connector 32. As described in U.S. Pat. No. 6,782,668, the field connector includes a tube portion 42 (FIG. 7*b*) sized to telescope over the frame element 16 or other frame elements, and a fin 44 with aperture 46 for a pivot bolt. The connectors are bolted or otherwise fastened together.

Figure 2:
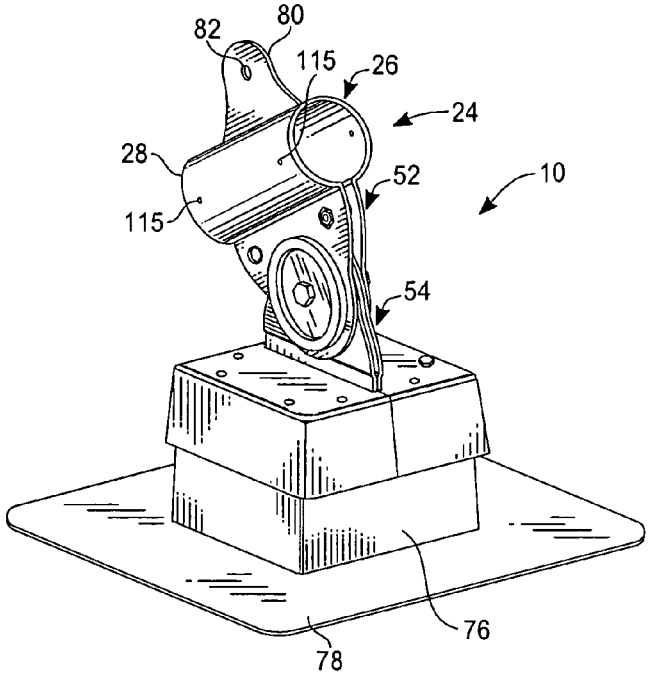
FIG. 2 is a perspective view of the structural mounting of FIG. 1.
Figure 3:
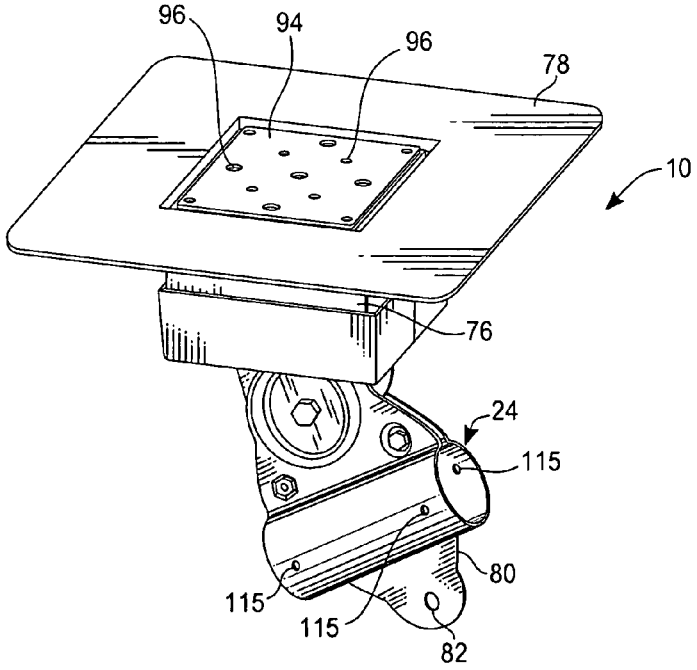
FIG. 3 is a perspective bottom view of the structural mounting of FIG. 2.
Figure 4A:
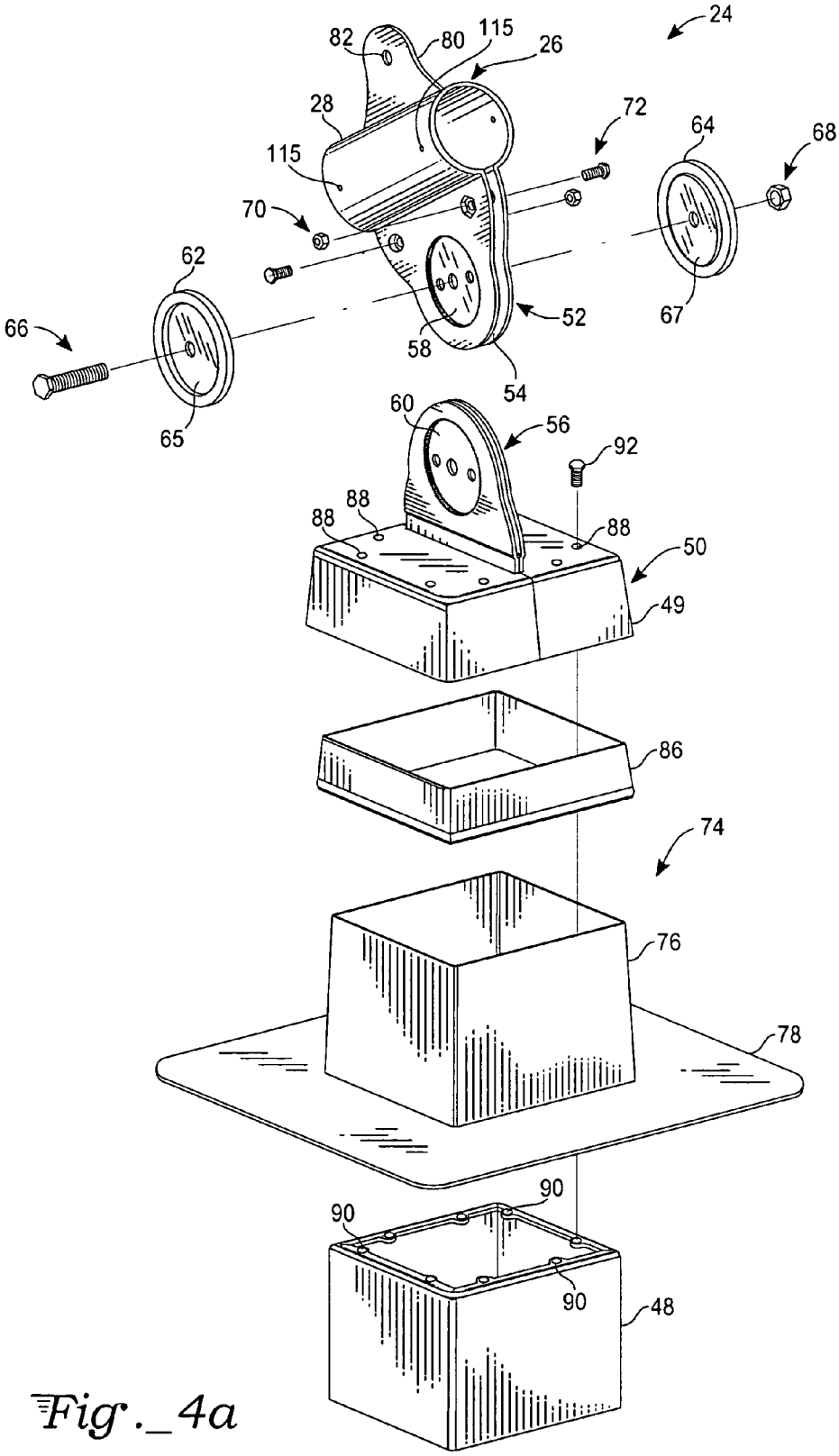
FIG. 4*a* is an exploded view of the structural mounting of FIG. 2.

With reference to FIGS. 2, 3, and 4*a*, there is seen an example of the structural mounting 10 of the present invention. As described above, the structural mounting is connected to a frame, such as frame 18 (FIG. 1), including frame elements that are connected to the equipment to be supported. The structural mounting features a base support 48, a base cap 50, and base connector 24 having frame support 26. The base connector 24 is configured to move and typically pivot about the base cap 50 including a base cap body 49 to achieve a desired position of the base connector 24 for easy connection to a frame element of a frame connected to the equipment or structure to be supported. One of the base cap 50 and the base connector 24 include a pair of plates having an opening there between and the other of the base cap and the base connector include at least one plate that is received by the opening. In the pictured example, the base connector 24 includes a pair of plates 52 having an opening 54 there between that is large enough to receive a pair of plates 56 disposed on the base cap 50. When the base connector plates 52 receive the base cap plates 56, the base connector 24 is moveable or pivotable about the base cap 50. In another example, the base cap 50 includes a pair of plates that receive one or more plates from the base connector 24 allowing the base connector to pivot. The pair of plates receiving the one or more plates may be inwardly biased towards the plate or plates it receives.

The base connector 24 is, in one example, composed of steel or other durable material and may include a fin plate 80 having a pre-punched pilot hole 82 (FIGS. 2 and 4*a*) to receive a pivot bolt 84 (FIG. 1) that secures the fin of the base connector to a connector, for example end connector 30, after pivoting adjustments have been made so as to provide a fixed connection between the base connector 24 and the end connector 30.

In one example of the present invention (FIG. 4*a*), each side of the plates of the base connector and base cap include a recessed area (recessed areas 58 and 60 are pictured) which receives a washer 62 or 64 used in conjunction with nut 66 and bolt 68 to secure the base connector 24 to the base cap 50 at a position in which the recessed areas of the base cap and base connector are in alignment and at a desired position for the base connector after pivoting or other adjustments have been made to provide a fixed position of the base connector and base cap until the fastener or fastener assembly is removed or disassembled. In one example, the washers 62 and 64 each include a surface 65 or 67 having an opening for receiving a fastener. A washer surface is, in one example, recessed. One or more nut and bolt assemblies such as assemblies 70 and 72 may be used to secure or clamp the plates of the pair of plates 52 together after pivoting or other adjustments have been made. In addition to, or instead of, the nut and bolt assembly, other fasteners may be used.

Figure 4B:
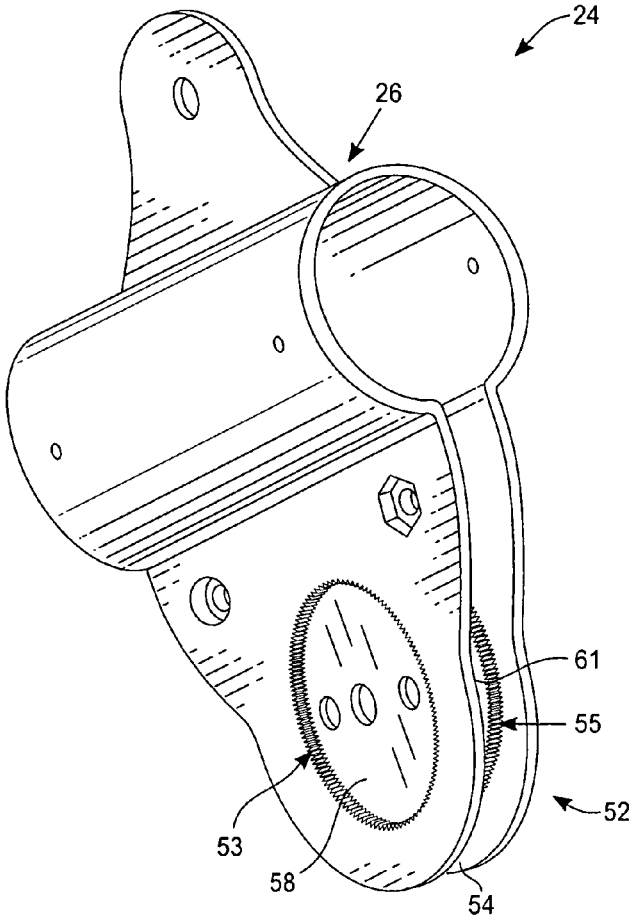
FIG. 4*b* is a magnified view of the base connector and a portion of a base cap of FIG. 4*b*.
Figure 4B:
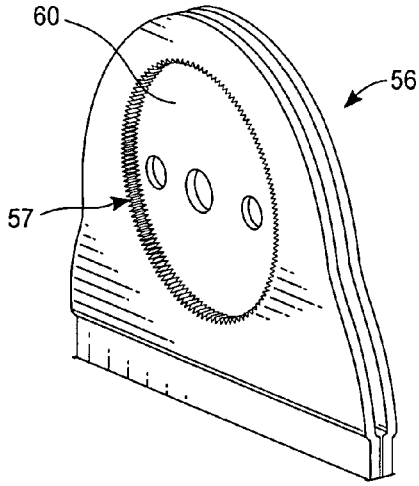
Figure 4C:
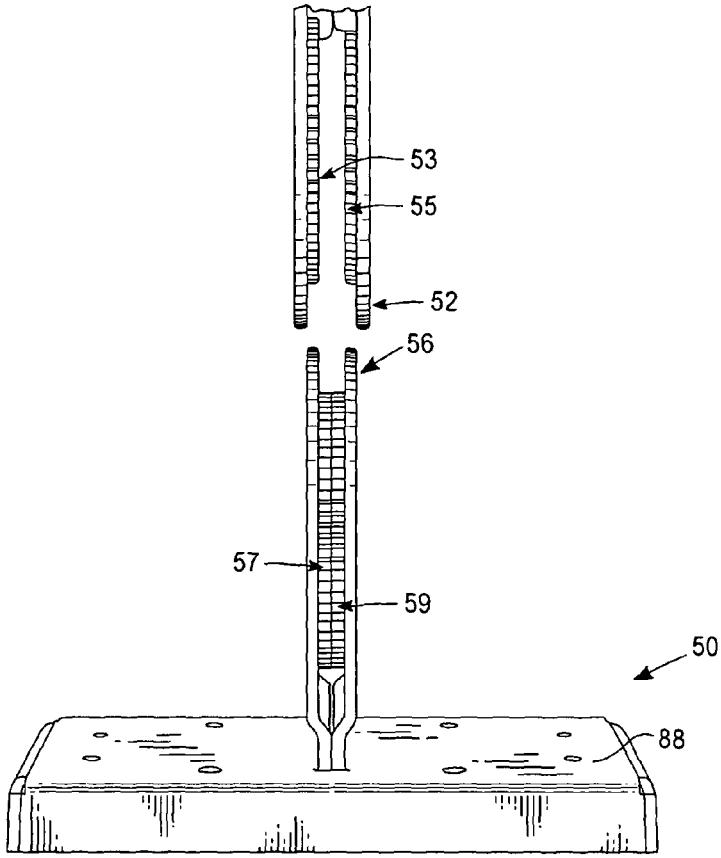
FIG. 4*c* is a side view of the base connector plates and base cap plates as seen in FIG. 1, featuring teeth.
Figure 4D:
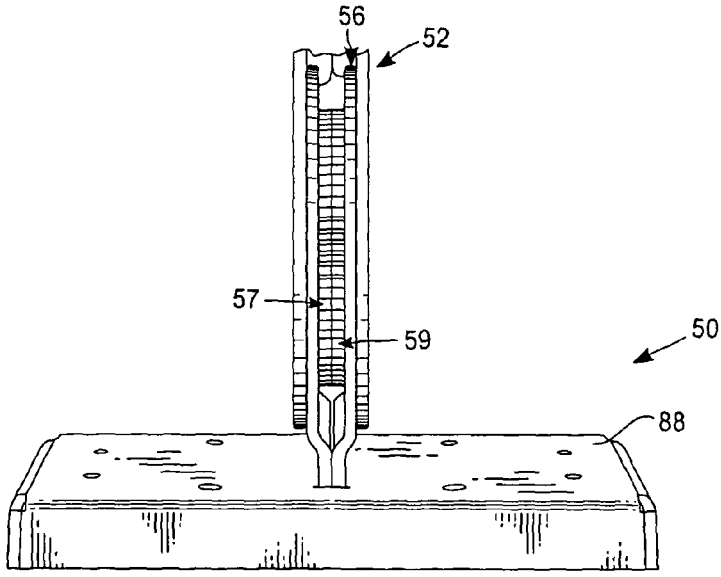
FIG. 4*d* is a side view of the teeth of the base connector plates see in FIG. 4*c* interlocked with teeth of the base cap plates seen in FIG. 4*c*.

With reference to FIGS. 4*b* and 4*c*, teeth or sprockets 53 and 55 are disposed about the recessed areas 58 and 61 of base connector plates 52 and teeth or sprockets 57 and 59 are disposed about the recessed areas 60 and an opposing recessed area (not shown) of the base cap plates 56. When the base connector plates 52 receive the base cap plates 56 and, for example, when one or more fastener assemblies, such as bolt assemblies 70 and 72 (FIG. 4*a*), are tightened, the teeth 53 and 57 lock together, and the teeth 55 and 59 lock together, further securing the base connector to the base cap. An engaged teeth position is seen in FIG. 4*d* which depicts base connector 24 engaging the base cap 50. In one example, the teeth of the base connector are spaced apart by gaps which receive the teeth of the base cap, and vice versa.

In one example of the present invention, the structural mounting of the present invention may include a base flashing 74 (FIG. 4*a*) with a riser 76 and a base 78. The inside dimension of the riser is, in one example, slightly larger that the outside dimension of the base support 48. Other sizes may be provided. The base flashing 74 is slipped over the base support 48, in one example, after the base support 48 is bolted to the roof. The base flashing provides weather protection for the structural mounting.

Figure 4E:
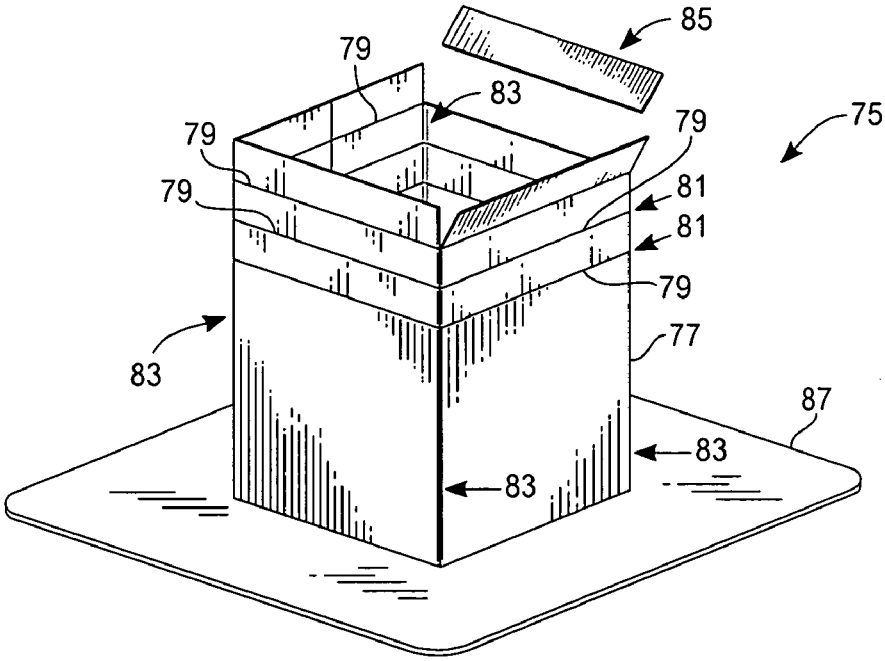
FIG. 4*e* is a perspective view of a base flashing of the present invention.

In one embodiment of the present invention, a base flashing, for example base flashing 75, seen in FIG. 4*e* includes a base support 87 and riser 77 with a series of creases 79 which allow for a height adjustment of the flashing. A series of creases 79 may form a continuous crease 81 disposed about the perimeter of the rising and a crease 83 may be disposed along each corner length of the riser. When the flashing is folded along a horizontal crease 79 and vertical creases 83 one or more times, a portion 85 of the flashing is broken off. In one example, four portions of the flashing are folded along the horizontal and vertical creases and, broken off resulting in a shorter flashing. In one example, the creases 79 are separated by, for example, 1 inch or ½ inch increments, thereby resulting in a decrease in height of the base flashing by 1 inch or ½ inch at one or more portions. The areas may be separated in height by an desired distance. Typically, all portions at the same height are broken off when a single portion such as 85 is broken off such that the height of the base flashing remains even. The riser is in one example metallic. The riser is sufficiently thin such that the portions may be broken off by folding. Other shapes of flashings may be used, for example, shapes with or without corners.

In one example, the structural mounting of the present invention further includes a base gasket 86 (FIG. 4*a*), in one example composed of rubber, and disposed about the base flashing 74. The base gasket provides weather protection by preventing water from contacting the inside of the flashing and the base support 48. The inside dimension of the base gasket is, in one example, slightly larger that the outside dimension of the base flashing. Other sizes may be provided. The base gasket is slipped over a top portion of the base flashing.

The base cap 50 is, in one example, composed of steel or other durable material and is sized to slip over base support 48 and, if present the base flashing 74 and/or gasket 86. The base cap includes pre-punched pilot holes 88 in vertical alignment with pre-punched pilot holes 90 of the base support 48 when the structural support 10 is assembled. After the base cap 50 is slipped over the base support 48, and the base flashing and/or gasket, if present, bolts 92, or other fasteners, extending through the base cap opening 88 and base support openings 90 secure the base cap to the base support.

Figure 5:
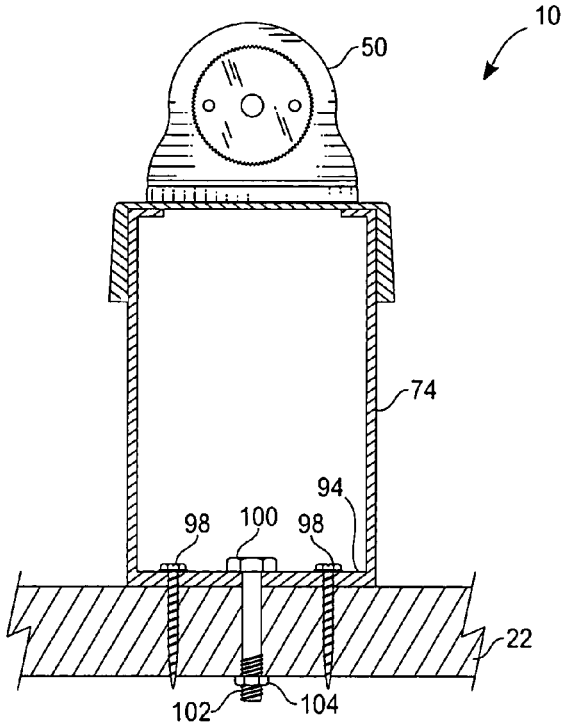
FIG. 5 is a front cutaway view of an example of a base cap and base support of an example of the present invention.

Referring to FIGS. 3 and 5, the structural mounting further comprises a base surface 94 having openings or through-holes 96 through each of which a fastener, such as a screw or a bolt, extends. In one example, a self drilling screw 98 is screwed through openings to secure the base surface 94 and the rest of the connected structural mounting to the roof or other desired surface. In another example, a bolt 100 with for example a nut 102 and washer 104 assembly is used. For example, a metal decking having a steel joist (not shown) may be applied to the roof surface and the fasteners may extend through openings disposed in the metal decking and steel joist.

Figure 6:
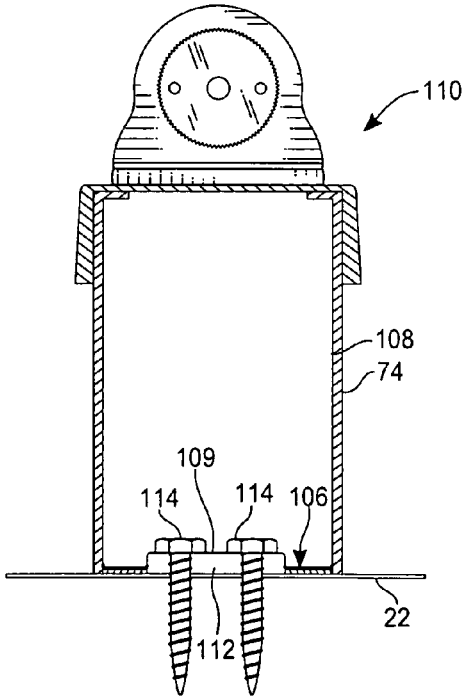
FIG. 6 is a front cutaway view of an example of a base cap and base support of an example of the present invention including an elevated base.

Referring to FIG. 6, in one example of the present invention, base surface 106 of the base support 108 of structural mounting 110, or any other desired structural mounting, includes an elevated portion 109 that is elevated from the rooftop surface 22 and relative to other portions of the base support surface. A chamber 112 is formed between the rooftop surface 22 and the elevated base support portion 109 of base surface 106. Fastener thru-holes (not shown) are disposed in the raised surface. Fasteners, such as self drilling screws 114, are disposed in the holes and extend through the chamber to the roof. A sealant is poured or injected into the chamber 112 around the fasteners to seal the fasteners and secure the structural mounting to the roof.

Referring to FIGS. 8*a*-8*e*, there are seen various examples of structural mountings of the present invention including various examples of different frame support elements. FIG. 8*a* shows structural mounting 10 including base cap 50 with plate members 56 (FIG. 4), base support 48, and a frame support or rest comprising a tubing support element 28, seen in FIG. 4*a*. A frame element to be supported (not shown) rests on the tubing support element. Plates 52 are attached to or integral with the tubing and receive the plates 56 of the base cap 50. Fasteners (not shown) may extend through openings 115 in the support tubing to attach the tubing to a frame element.

FIG. 8*b* shows a structural mounting 116 including a frame support or rest 118 comprising a flat base 119 and two opposed sides 121 and 123 perpendicular to the base. A frame element to be supported (not shown) rests on the base. Plates 120 are attached to or are integral with the support element 118 and receive base cap plates 122. Fasteners may extend through openings 124 in the opposed sides to attach the mount 118 to a frame element.

FIG. 8*c* shows a structural mounting 126 including a frame support or rest 128 comprising a flat plate mount 129. A frame element to be supported (not shown) rests on the mount. Plates 130 are attached to the mount and receive base cap plates 132. Fasteners (not shown) may extend through openings 131 in the mount 130 to attach the mount to the frame element.

FIG. 8*d* shows a structural mounting 134 including a frame support or rest 136 comprising an "L" shaped mount 138 including a base 140 and a side 142 perpendicular to the base. A frame element to be supported (not shown) rests on the base. Plates 144 are attached to or are integral with the mount 138 and receive base cap plates 146. Fasteners (not shown) may extend through openings 148 in the mount to attach the mount to a frame element.

FIG. 8*e* shows a structural mounting 150 including a frame support or rest comprising vertical plate mount 152. A frame element to be supported (not shown) is connected to the vertical plate mount 152. The vertical plate mount 152 is received by two base cap plates 154. Fasteners (not shown) may extend through openings 156 in the mount to attach the mount to a frame element. Each of the various structural mountings include plates having a recessed area to receive a washer, nut and bolt assembly as described above with regard to structural mounting 10.

The tube frame support of the structural mounting of FIG. 2 could be substituted for any of the above types of frame supports or other support elements. Also, in one example, variations are made in whether the frame support or the base cap includes the receiving plates as opposed to the plate or plates that are received. Though particular types of fastening means have been described herein, any desired type of fastening means may be used.

What we claim is:

1. A structural support comprising:

a base support mountable on an exterior roof surface;

a base cap atop said base support and having a substantially same cross-sectional shape as said base support; and an interchangeable base connector having a rest with a shape varying in shape between different types of interchangeable base connectors, said interchangeable base connector interchangeable with a second interchangeable base connector having a rest with an alternate shape and said interchangeable base connector connected to and disposed above the base cap, wherein one of said interchangeable base connector and said base cap includes a pair of plates having an opening therebetween and the other of said interchangeable base connector and said base cap includes at least one plate receivable within said opening allowing for a pivotable movement of said interchangeable base connector about said base cap when said at least one plate is received, wherein said plates each include a recessed surface and teeth disposed about each recessed surface.

* * * * *